US007793950B2

(12) United States Patent
Van Eeden

(10) Patent No.: US 7,793,950 B2
(45) Date of Patent: Sep. 14, 2010

(54) INTER-CONVERTIBLE SINGLE PERSON TYPE TRANSPORTING AID

(76) Inventor: Adriaan Van Eeden, 733 Steekbaard Street, Garstontein Ext 10, Pretoria (ZA)

( * ) Notice: Subject to any disclaimer, the term of this patent is extended or adjusted under 35 U.S.C. 154(b) by 515 days.

(21) Appl. No.: 10/574,037

(22) PCT Filed: Sep. 20, 2004

(86) PCT No.: PCT/ZA2004/000111

§ 371 (c)(1),
(2), (4) Date: Jun. 8, 2007

(87) PCT Pub. No.: WO2005/030105

PCT Pub. Date: Apr. 7, 2005

(65) Prior Publication Data

US 2008/0231006 A1 Sep. 25, 2008

(30) Foreign Application Priority Data

Sep. 26, 2003 (ZA) ..... 03/7484

(51) Int. Cl.
*A61H 3/04* (2006.01)

(52) U.S. Cl. ..... 280/87.041; 180/65.1; 280/87.03

(58) Field of Classification Search ..... 280/87.041, 280/87.021, 87.01, 23.1, 79, 32.6, 7.1, 5.2, 280/5.32, 5.28, 87.03; 180/8.1, 8.2, 65.1
See application file for complete search history.

(56) References Cited

U.S. PATENT DOCUMENTS 4,096,920 A * 6/1978 Heyn ..... 180/11
4,280,578 A 7/1981 Perkins
4,902,029 A * 2/1990 Gain et al. ..... 280/304.1
5,060,967 A * 10/1991 Hulterstrum ..... 280/650
5,265,689 A * 11/1993 Kauffmann ..... 180/65.51
5,340,140 A * 8/1994 Bynum ..... 280/304.1
5,366,036 A * 11/1994 Perry ..... 180/65.1
5,435,404 A * 7/1995 Garin, III ..... 180/6.5
5,445,233 A * 8/1995 Fernie et al. ..... 180/6.5
5,558,358 A * 9/1996 Johnson ..... 280/648
5,575,348 A * 11/1996 Goertzen et al. ..... 180/65.6
5,778,996 A * 7/1998 Prior et al. ..... 180/65.1
5,819,772 A 10/1998 Pi
5,944,131 A * 8/1999 Schaffner et al. ..... 180/65.1

(Continued)

FOREIGN PATENT DOCUMENTS

CA 2103292 A1 5/1995

(Continued)

*Primary Examiner*—Jeffrey J Restifo
(74) *Attorney, Agent, or Firm*—Wyatt, Tarrant & Combs, LLP; H. Roy Berkenstock

(57) ABSTRACT

An inter-convertible single person type transporting aid (10) comprises a multi directionally propellable wheeled carrier frame (12) that is fitted with drive wheels (14) that are independently drivable via motors (16) and situated to enable aid central axis turning. The frame (12) is constituted from an upper frame part (20) displaceably mounted to a wheeled base frame (22) fitted at its outer corners with castors (24). The upper frame part (20) is biased in the direction of arrow (30) relative to the base frame (22). The aid (10) is re-arrangeable into a walk supporter or walker (38), a sitting transporter and a standing transporter by the removable fitting of a seat and a standing platform respectively.

5 Claims, 3 Drawing Sheets

U.S. PATENT DOCUMENTS

| | | | | |
|---|---|---|---|---|
| 6,378,883 | B1 | 4/2002 | Epstein | |
| 6,443,252 | B1 * | 9/2002 | Andes | 180/65.1 |
| 7,040,429 | B2 * | 5/2006 | Molnar | 180/65.1 |
| 7,066,290 | B2 * | 6/2006 | Fought | 180/65.51 |
| 7,219,755 | B2 * | 5/2007 | Goertzen et al. | 180/65.1 |
| 7,344,155 | B2 * | 3/2008 | Mulhern et al. | 280/755 |
| 7,360,792 | B2 * | 4/2008 | Turturiello et al. | 280/755 |
| 7,374,002 | B2 * | 5/2008 | Fought | 180/65.51 |
| 7,438,145 | B2 * | 10/2008 | Shin | 180/65.1 |
| 7,472,767 | B2 * | 1/2009 | Molnar | 180/65.1 |
| 7,490,683 | B2 * | 2/2009 | Schaffner | 180/65.1 |
| 7,506,709 | B2 * | 3/2009 | Kiwak et al. | 180/65.1 |
| 7,597,163 | B2 * | 10/2009 | Goertzen et al. | 180/65.1 |

FOREIGN PATENT DOCUMENTS

| | | | |
|---|---|---|---|
| DE | 19648419 | A1 | 5/1997 |
| FR | 2741528 | A1 | 5/1997 |
| GB | 2307455 | A | 5/1997 |

* cited by examiner 44
34
36
46
10,38
48
20
52
26,26.1
A
12
28
32
26,26.2
18
16
B
24
22
14
30

INTER-CONVERTIBLE SINGLE PERSON TYPE TRANSPORTING AID

BACKGROUND TO THE INVENTION

Single person type transporting equipment and aids are often found in the health impaired environment or for use by the aged. Typically are a wheel chair and a walker. Normally such equipment serves a single purpose only. With the increased cost of transportation and congestion the availability of economical single person transportation is becoming increasingly more important for general use as well. While conditions of general use do not require the ability to do tight turns, specialised single person transporting equipment used indoors often requires such ability. The availability of inter-convertible transportation equipment serving both a general and specialised purpose while accommodating particular circumstances is consequently of substantial importance.

1. Field of the Invention

This invention relates to an inter-convertible single person type transporting aid employable for everyday use as well as in a specialised environment such as under conditions of health impairment.

2. Prior Art Description

Single person type transportation equipment is mainly found in the environment of health impaired or aged person use. Specialised single person transporting equipment being able to serve a number of purposes is found in the prior art. U.S. Pat. No. 6,378,883 shows a motorized walker that can also be used as wheel chair type equipment. Its use as a walker does not incorporate the standard semi enclosing frame which accommodates the ease of use of such equipment. While it is formed with wheels at outside positions this walker will not be able to perform tight turns such as in a corridor of a hospital or a home for the aged. U.S. Pat. No. 6,460,641 shows a motorized wheel chair with drive intermediate its outside wheels apparently enabling its performing tight turns. The equipment of this invention is however not inter-convertible to enable its performing a variety of other single person transporting functions.

BRIEF DESCRIPTION OF THE DRAWING

The invention is now described, by way of example, with reference to the accompanying drawings. In the drawings

DETAILED DESCRIPTION OF THE DRAWINGS

Figures 1, 2, 3, 4, 5:
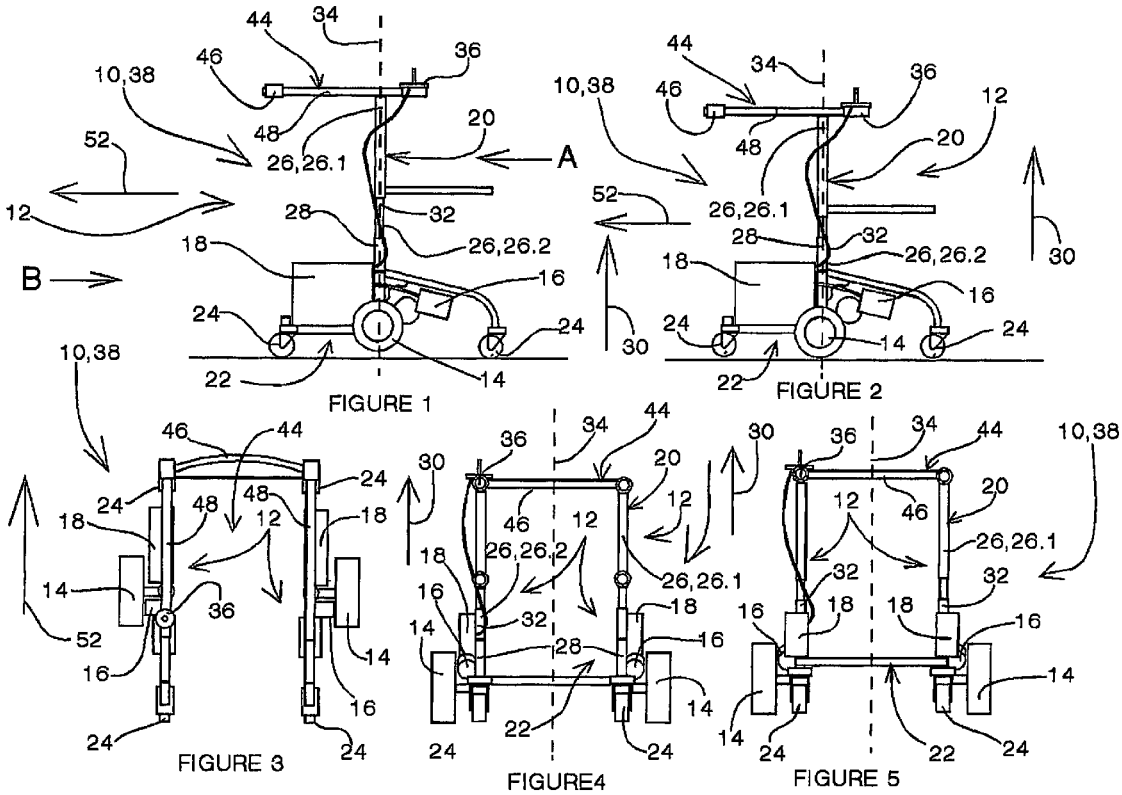
FIG. 1 shows an inter-convertible single person type transporting aid, according to the invention, convertible between a walk support providing condition, a sitting transporter providing condition and a standing transporter providing condition in a drive wheel non-engaging side elevational walk support providing condition.
FIG. 2 shows the aid in its drive wheel engaging side elevational walk support providing condition.
FIG. 3 shows the aid in its plan view support providing condition.
FIG. 4 shows the aid in direction of arrow A in FIG. 1.
FIG. 5 shows the aid in the direction of arrow B in FIG. 1.
Figure 6:
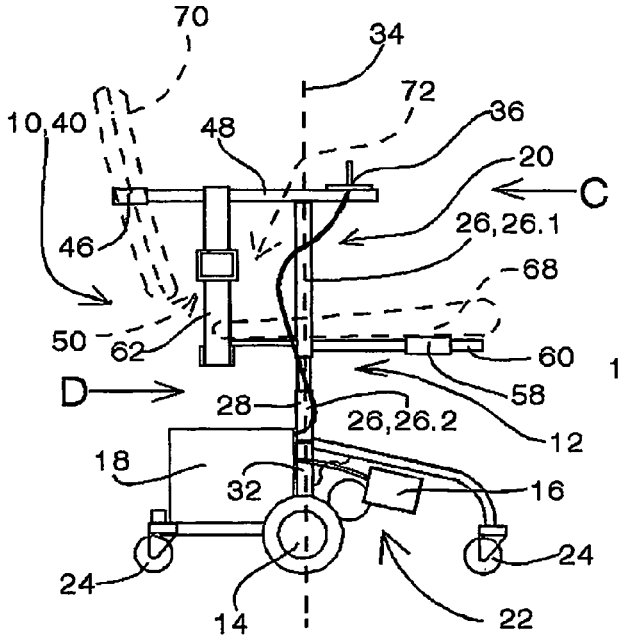
FIG. 6 shows the aid in its side elevational sitting transporter providing condition.
Figure 7:
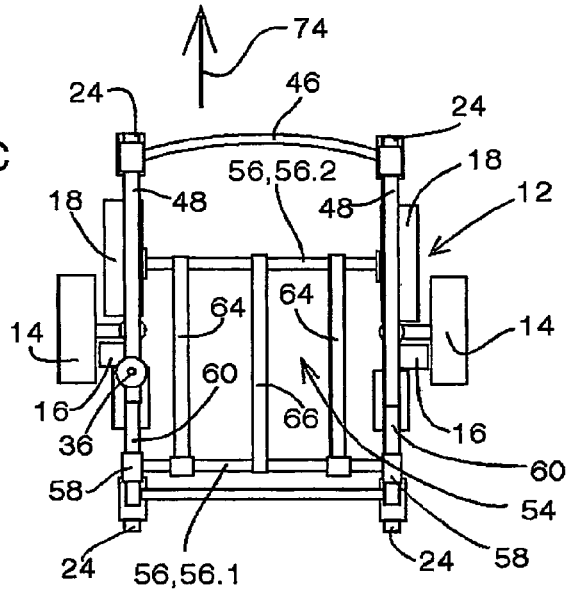
FIG. 7 shows the aid in plan view in its sitting transporter providing condition.
Figure 8:
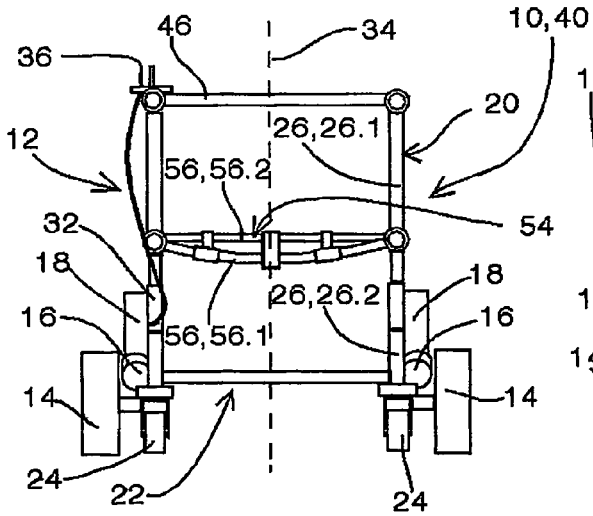
FIG. 8 shows the aid in the direction of arrow C in FIG. 6.
Figure 9:
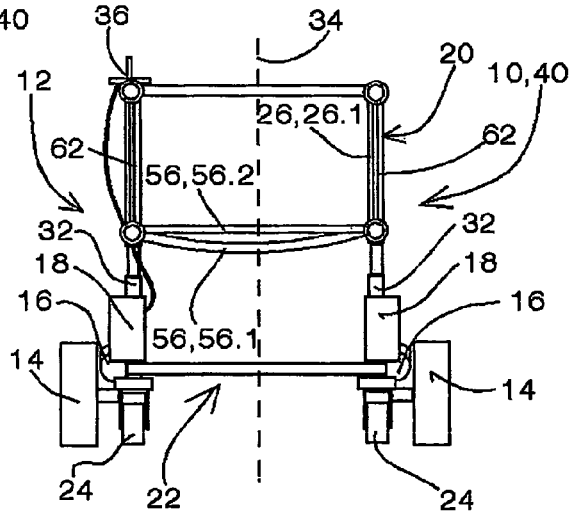
FIG. 9 shows the aid in the direction of arrow D in FIG. 6.
Figure 10:
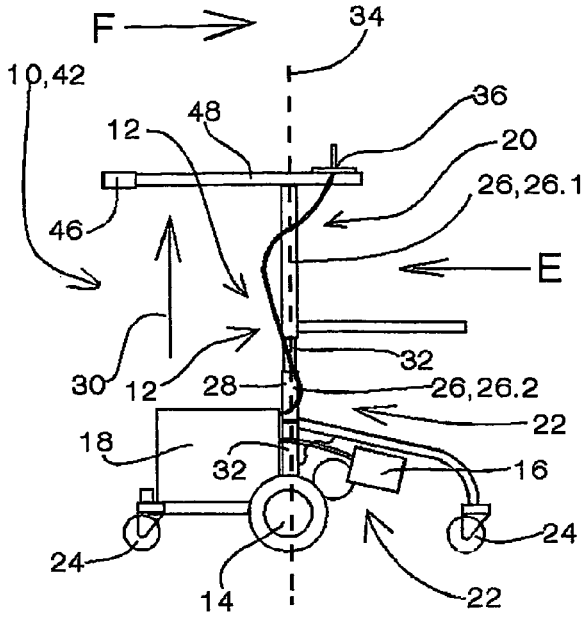
FIG. 10 shows the aid in its side elevational standing transporter providing condition.
Figure 11:
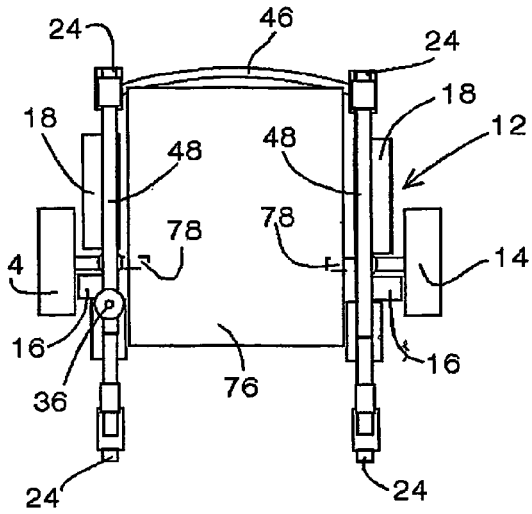
FIG. 11 shows the aid in plan view in its standing transporter providing condition.
Figure 12:
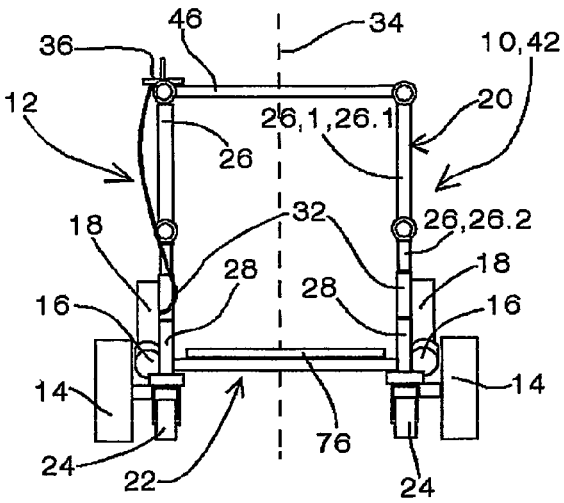
FIG. 12 shows the aid in the direction of arrow E in FIG. 10.
Figure 13:
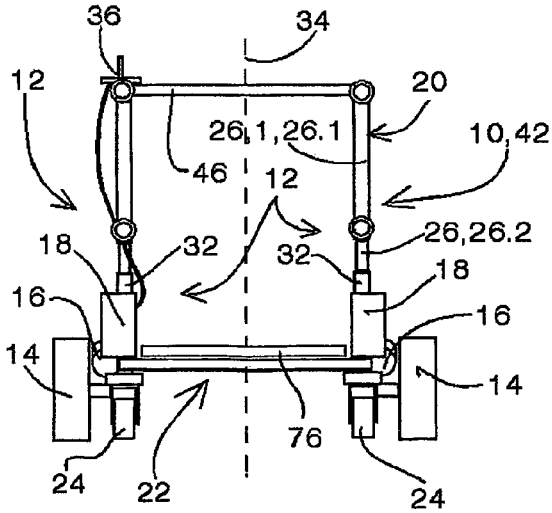
FIG. 13 shows the aid in the direction of arrow F in FIG. 10.

Referring to the drawings an inter-convertible single person type transporting aid employable as walk supporter, sitting transporter and standing transporter in response to appropriate conversion or re-arrangement is generally indicated by reference numeral 10.

The aid 10 comprises a multi directionally propellable wheeled carrier facility in the form of a carrier frame 12 that is fitted with a drive wheel arrangement in to form of laterally situated drive wheels 14 that are drivable by powerable propulsion means in the form of battery driven motors 16 powered from batteries held by battery holders 18. The frame 12 is constituted from a drive wheel carrying user accommodating part in the form of an upper frame part 20 displaceably mounted to a wheeled base frame 22 fitted at its outer corners with castors 24.

The upper frame part 20 is so displaceably mounted by way of drive wheel carrying arms 26 that fit displaceably along sleeves 28 while being biased in the direction of arrow 30 relative to the base frame 22 by way of a spring (not shown) covered by spring covers 32. The wheels 14 are secured to the lower ends of the arms 26 respectively and are urged out of rolling base engaging contact by the springs except when the frame part 20 is exposed to a downward exerted force, as discussed below.

The drive wheels 14 are situated laterally of the central axis 34 of the aid 10 in a plane that extents through the axis 34 and generally centrally through the aid 10. The drive wheels 14 are also independently drivable in both directions by means of their motors 16. Running of the motors 16 are controlled by means of a conventional multi directional controller 36 mounted on the upper frame part 20. Being so drivable in opposite directions enables the aid 10 to be turned about the axis 34 having the result that when the aid is converted to a sitting transporter performing condition or a standing transporter performing condition, both as discussed in more detail below, the aid 10 can turn on the spot where it stands by driving the wheels 14 in their opposite directions.

Although not shown, when the drive wheels 14 are inherently non-suspensive they can be mounted on sprung pivotal arms rendering the upper frame part 20 suspensive. The drive wheels 14 are mounted to only rotate when their drive motors 16 are powered. When not so powered the wheels 14 are restrained against rotation thus serving a rolling base engaging braking function when urged into abutment with such base.

The aid 10 is thus inter-convertible between a walk supporter or walker 38, as discussed further on with reference to FIGS. 1 to 5, and a sitting transporter 40 as discussed further on with reference to FIG. 6 to 9 and a standing transporter 42 as discussed further on with reference to FIG. 10 to 13.

Referring to FIGS. 1 to 5 the upper frame part 20 of the aid 10 presents a semi enclosing frame 44 defined by a transverse gripping handle providing frame member in the form of a gripping handle 46 extending into user accommodating part laterally situated semi loop formation contributing arms 48 integrally incorporated into the upper frame part 20 within which frame 44 a user is situated once using the aid 10 as walker. When the aid 10 has been used as a sitting transporter 40 or standing transporter 42 prior to conversion to a walker 38, the wheeled base frame 22 extends substantially rectangular when viewed in plan view.

Once so converted the aid 10 is in its conventional walker providing form, movement of which during use takes place in generally the direction of arrow 52.

When used as walker 38 the aid 10 is only used to assist the walker user in the conventional walking action resulting in only a small downward urging being exerted on the upper frame part 20 in response to the manual gripping of the semi enclosing frame 44. The biasing springs biasing the upper frame part 20 away from the base frame 22 are selected to maintain their biasing action except when exposed to a substantial downward force that is at any rate larger that the force so exerted on the upper frame part 20 when the aid 10 is conventionally used as walker. In consequence and as shown in FIG. 1 the drive wheels 14 are maintained out of rolling base engaging contact by the springs when the aid 10 is so conventionally walker fashion used with aid motion being promoted via the castors 24. Should a user however require the exertion of a braking effect on the walker 38 during use and referring to FIG. 2, an increased downward force is simply exerted on the upper frame part 20 via the semi enclosing frame to the extent of overcoming the bias of the springs thus causing the drive wheels 14 to come into rolling base abutment. As the wheels 14 when not driven by their motors 16, are restrained from rotation, their urging against the rolling base once the aid 10 is walker fashion used has the effect of braking the progress of the walker 38 thus aiding in controlling its motion.

When in its walker providing condition the aid 10 is easily collapsible to promote its ease of transportation. To this end the gripping handle 46 engages releasably with the arms 48. Each of the drive wheel carrying arms 26 is constituted from an upper section 26.1 and a lower section 26.2. The upper sections 26.1, as forming part of the upper frame part 20, engage bayonet fashion with the lower sections 26.2, as forming part of the base frame 22. The upper sections 26.1 include the springs as covered by the covers 32. They thus engage releasably with the bottom sections 26.2 just below the springs. The upper and lower sections 26.1, 26.2 are maintained locked to one another by the locking action of the handle 46. To collapse the aid 10 the handle 46 is simply removed freeing the upper and lower frame sections 26.1 and 26.2 to be bayonet coupling fashion uncoupled having the effect of separating the upper frame part 20 (though with the handle removed) from the base frame 22.

Conversion of the aid 10 from its walker providing condition to its sitting transporter providing condition, while also referring to FIGS. 6 to 9, involves the use of the seat arrangement 50. This thus comprises the securing of a seat base support grid 54 to the upper frame part 20. The grid 54 is constituted from opposing end bars 56 of which the one bar 56.1 is slidably engaged via end sockets 58 with seat forming arms 60 integrally forming part of the upper frame part 20 while the opposite bar 56.2 is suspended from the semi loop formation contributing arms 48 via slings 62. The grid 54 is formed by the securing of grid connectors 64 to extend between the opposing bars 56. As further support one or more support straps 66 are slung to extend between the opposing bars 56. A seat base 68 is thus secured to the grid 54. A seat backrest 70 is furthermore secured to the gripping handle 46. The seat base 68 s and backrest 70 together define the seat 72 of the sitting transporter 40. As an alternative although not shown the seating portion of the seating arrangement 50 can be swivellably secured via its trailing axis to the upper frame part 20 causing it to form an integral part of the carrier frame 12.

The direction of forward travelling of the aid 10 when converted to the sitting transporter 40 is in the direction of arrow 74 and thus opposite to that of the aid 10 when converted to the walker 38. Owing to the drive wheels 14 being drivable in both directions the sifting transporter 40 can naturally be driven in both directions. The biasing effect of the springs are selected to result in the upper frame part 20 being urged downward once the seat 72 is occupied resulting in the drive wheels 14 coming into sitting transporter driving contact with a rolling base.

Conversion of the aid 10 from its walker providing condition to its standing transporter providing condition, as shown in FIGS. 10 to 13, is achieved by simply fitting a standing base 76 to the base frame 22, while naturally requiring removal of the seating arrangement 50 when conversion is from the sitting transporter providing condition or swivelling the seat of the arrangement 50 upward and removing the backrest portion. To ensure that the effect of drive wheel to rolling base engagement can be achieved in this case the lower ends of the arms 26 are formed with inwardly projecting lugs 78 facing into the intermediate zone of the base frame 22. Operative fitting of the standing base 76 thus also involves its edgewise location onto the lugs 78 in addition to resting on either the front or rear cross arms of the frame 22. Once a user is positioned on the standing base 76 the downward force of the user's weight causes the downward urging of the upper frame part 20 resulting in drive wheel to rolling base engagement for riding the aid 10 in a standing condition.

As the aid 10 is constituted of several removably mountable parts the invention also relates to a set constituted from the carrier frame 12, as separable into an upper frame part 20 and a base 22, the seating arrangement 50 or at least its backrest 70 and the standing base 76.

The aid 10 provides the advantage that a multi-purpose single person type transporter is provided that can be used for both general and specialised purposes.

The invention claimed is:

1. A powered convertible walker/wheelchair/transporter aid useable selectively as a walker, wheel chair or a transporter for traversing a support surface, comprising:

a generally rectangular wheel-base frame, including forward and rearward leg sections attached generally at the lower region thereof, and extending generally parallel to the support surface, said leg sections having a weight-bearing caster disposed on the underside thereof, whereby said forward and rearward leg sections form a rollable frame for said transporter; and an upper frame mounted on said base frame, including a pair of transporter vertical supports, each selectively carrying longitudinal supporting arms disposed in generally parallel relation at the upper ends thereof, and each supporting arm removeably secured to a first end of each supporting arm by a lateral gripping handle whereby said arms and handle form a generally U-shaped upper frame with said vertical supports; and each of said vertical supports has disposed at its lower ends, generally adjacent said leg sections a sleeved coupling attached to said base frame, and including a drive wheel, wherein said coupling has therein a spring biasing unit to position said vertical supports and drive wheel upwardly and free of said support surface when said vertical supports are unloaded and said drive wheel and vertical supports are moveable downwardly to contact said support surface in a driving condition, as upon loading said vertical support beyond the spring bias in said sleeve coupling, whereby said transporter functions as a free-wheeling walker in the unloaded condition and as a driven wheelchair/transporter when in a loaded condition.

2. The apparatus of claim 1 wherein each drive wheel is separately controllable.

3. The apparatus of claim 2 wherein a seat is disposed intermediate said vertical supports, generally intermediate the supporting arms thereof oriented such that an included back of the seat is supported by the handle.

4. The apparatus of claim 2 wherein a load transport platform is disposed intermediate said vertical supports, generally adjacent the lower ends thereof and said base frame, and oriented such that it is supported by said vertical supports below the sleeves and in the space defined above by the handle and the supporting arms.

5. The apparatus of claim 2 wherein a control for operating the drive motors is disposed on one of the vertical supports adjacent one of the support arms.

* * * * *